United States Patent [19]

Audsley

[11] 4,028,018

[45] June 7, 1977

[54] NON-PULSING APPARATUS

[75] Inventor: Alan Keith Audsley, Winchester, England

[73] Assignee: Paterson Candy International Limited, London, England

[22] Filed: June 6, 1975

[21] Appl. No.: 584,467

[30] Foreign Application Priority Data

June 10, 1974 United Kingdom ..... 25732/74

[52] U.S. Cl. ..... 417/534; 92/13.3

[51] Int. Cl.[2] ..... F04B 21/04

[58] Field of Search ..... 417/539, 534–537, 417/437, 222, 274; 92/13.3, 60.5

[56] References Cited

UNITED STATES PATENTS

| | | | |
|---|---|---|---|
| 1,070,706 | 8/1913 | Luitwieler | 417/539 X |
| 1,723,874 | 8/1929 | Lunge | 417/539 X |
| 2,010,377 | 8/1935 | Sassen | 417/521 X |
| 2,101,829 | 12/1937 | Benedek | 91/498 |
| 2,322,181 | 6/1943 | Vincent | 417/273 |
| 2,676,608 | 4/1954 | Svenson | 417/273 X |
| 2,882,831 | 4/1959 | Dannevig | 91/498 |
| 3,046,950 | 7/1962 | Smith | 91/498 |
| 3,238,889 | 3/1966 | Huber et al. | 417/534 |
| 3,554,671 | 1/1971 | Schlinke | 417/222 |

FOREIGN PATENTS OR APPLICATIONS

| | | | |
|---|---|---|---|
| 1,800,142 | 4/1970 | Germany | 417/426 |
| 248,334 | 12/1925 | United Kingdom | 417/536 |

*Primary Examiner*—William L. Freeh
*Assistant Examiner*—Edward Look
*Attorney, Agent, or Firm*—Brown, Murray, Flick & Peckham

[57] ABSTRACT

Variable stroke pumping apparatus suitable for pumping chemicals in a pulseless manner irrespective of the stroke. The apparatus comprises a plurality of pumps connected in flow paths extending between a fluid inlet and outlet and a central housing containing a cam and cam follower devices mounted on a carrier which is pivotable to alter the stroke of the pumps while maintaining substantially constant aggregate pumping of the pumps. Pump reciprocating members for each pump, e.g. rams extend outwardly of the housing and are reciprocated by the cam follower devices.

2 Claims, 6 Drawing Figures

NON-PULSING APPARATUS

This invention relates to pumping apparatus in which pumping pulses are eliminated or at least greatly reduced.

Conventional reciprocating pumps reduce their deliveries towards the ends of their strokes and accelerate their deliveries at the commencement of their strokes. The pumping pulses in the delivery induced by these effects can be a nuisance in, for example, dose metering pumps. In consequence, gear or other forms of pump than simple reciprocating pumps are preferred for these applications.

A pulseless pump is known (U.K. Pat. No. 1,300,500), which may be used as a chemical pump. However, although this pump is pulseless for maximum stroke, as the length of stroke is varied pulsing increases, until it is maximum at strokes of minimum length.

An object of the invention is to provide a simple variable stroke pump which can be used for chemical dosing and which is pulseless, or substantially pulseless irrespective of the length of stroke. By "pulseless" is to be included pumps in which either the suction stroke, or the delivery stroke or both strokes are pulseless.

The invention provides pumping apparatus comprising a plurality of identical reciprocating pumps connected in flow paths extending between a fluid inlet and a fluid outlet, pump reciprocating means comprising a housing having a pump reciprocating member for each pump extending outwardly through the housing, the housing containing a respective cam follower device for each pump reciprocating member and cam means for actuating the cam follower device and being shaped to provide a substantially constant aggregate pumping of the pumps, wherein each cam follower device is pivotably mounted on pivotable carrier means and is shaped so that pivoting of the carrier means alters the stroke of each pump while maintaining subtantially constant aggregate pumping of the pumps.

In one embodiment of the invention there are two pumps and the cam is shaped to provide a substantially constant aggregate suction of the pumps.

Alternatively, the cam is shaped to provide a substantially constant aggregate delivery of the pump. Such a pump is particularly simple and can be used as a chemical pump for dosing corrosive chemicals.

The apparatus may, however, have more than two pumps. If three pumps are used, it is possible to arrange them so that the apparatus has a smooth suction rate as well as a smooth delivery rate.

Preferably the cam has a maximum and minimum point of camming lying on an axis of symmetry of the cam, and has six sectors extending equally around the cam, which sectors provide between the minimum and maximum points 60° of constant acceleration, 60° of constant velocity, and 60° of constant deceleration respectively.

Preferably, each cam follower is an arm pivotably mounted at one end on the carrier means and carrying a cam follower at the other end, eacharm having a convexly-curved surface engaging a ram of the respective pump.

Preferably, the pivoting mountings of the arms on the carrier means are arranged on a circle, the arms lying on the circle at maximum discharge of the pumps irrespective of the pivoting of the carrier means, and being movable radially inwardly of the circle.

The invention will now be described in more detail, by way of example, with reference to the accompanying drawings, in which.

Figure 1:
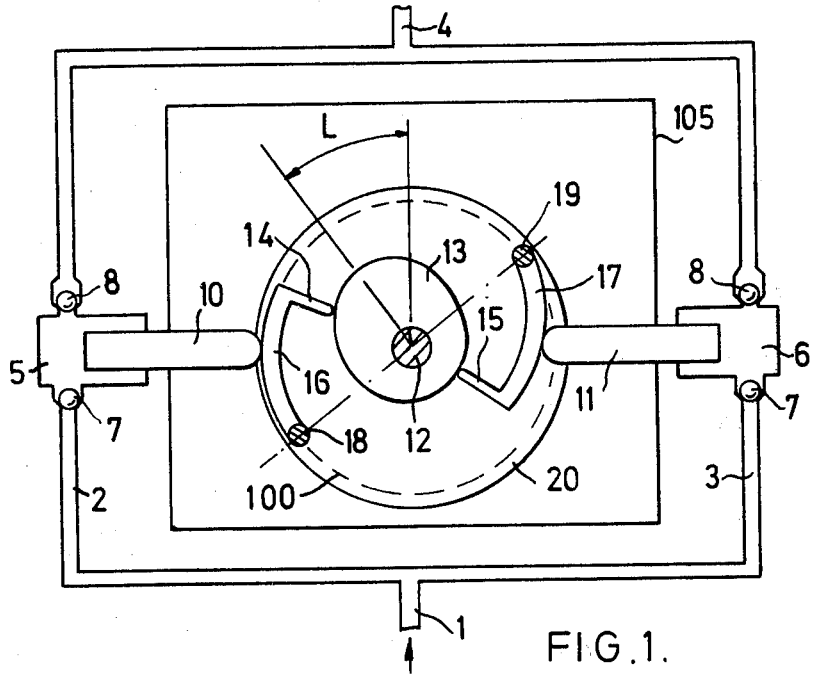
FIG. 1 is a diagrammatic representation of pumping apparatus.

The pumping apparatus of FIG. 1 has an inlet 1 which branches into a pair of parallel flow paths 2, 3 which deliver pumped liquid to a common outlet 4.

The flow paths 2, 3 contain respective pumps 5, 6. These are of identical construction and each is provided with a check valve 7 on its inlet side and a non-return valve 8 on its outlet side.

The pump 5 has a piston ram 10 which is reciprocated back and forth to operate the pump. Likewise the pump 6 has an identical piston ram 11.

The lines of action of the rams 10, 11 pass through the axis of rotation of a shaft 12 on which is mounted a cam 13 engaged on opposite sides by two cam followers 14, 15. The cam follower 14 is carried at one end of an arcuate lever arm 16 which is pivoted at its other end 18 and is borne on by the ram 10. In similar manner the ram 11 bears on the convexly curved outer surface of a second lever arm 17 pivoted at 19 and carrying the cam follower 15.

The pivotal points 18 and 19 are mounted on a carrier 20 which is manually movable through an angle L about the axis of rotation of the shaft 12. As is apparent from FIG. 1, the effect of reducing the angle L is to reduce the effective length of the lever arm effective to reciprocate the ram 10 as the corresponding cam follower 14, 15 follows the surface contour of the cam 13.

The carrier 20, the cam 13 and the pivoting arms 16, 17 are contained in a housing 105 into which the rams 10, 11 extend. The housing 105 may contain lubricant which is prevented from escaping around the rams by means of suitable seals (not shown). Thus, the liquid being pumped in flow paths 2 and 3, which liquid may be highly corrosive, is kept separate not only from the lubricant but also from the mechanism inside the housing 105.

The delivery rate of each pump does not vary sinusoidally in phase with the rotation of the cam. The cam 13 is so profiled, that the reduced delivery rate of one pump as it approaches the end of its stroke is compensated by an increased delivery rate of the other pump at the same time.

Figure 2:
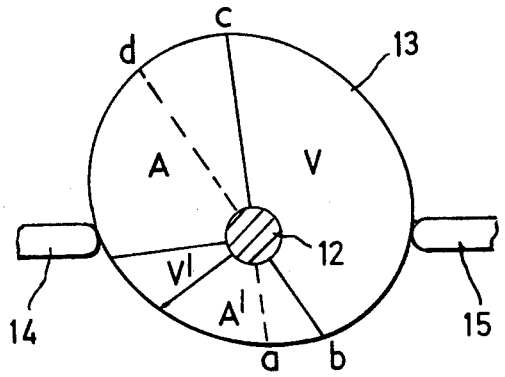
FIG. 2 shows a cam profile for producing a constant delivery or a constant suction rate.

FIG. 2 shows diagrammatically the function of the cam 13 of FIG. 1. The cam 13 is divided into four zones A,A′ and V,V′. The zones A,A′ each extend for 90° and move the followers 14, 15 with a constant acceleration. The zones V,V′ extend for 150° and 30° respectively and move the followers 14, 15 with a constant velocity.

Points along the cam in FIG. 2 are lettered *a* to *d*, where *a* is at the minimum cam radius (i.e. the commencement of delivery stroke, and *d* is at the maximum cam radius (i.e. the end of delivery stroke), so that the whole delivery stroke extends from *a* to *d* via *b* and *c*.

During a portion of the delivery stroke of each pump, corresponding to the portion of FIG. 2 extending for 150° from *b* to *c*, i.e. constant velocity sector V, the delivery rate of the pump is constant. Between *c* and *d* of the constant acceleration sector *a*, the delivery rate of one pump falls as it is approaching the end of its stroke at *d*. However, the other pump commences its delivery stroke at the position *a* diametrically opposite the point *c*. Thus the decline in pump delivery of one pump between *c* and *d* is compensated for by the additional delivery of the other pump operating between *a* and *b*.

As the delivery rate of one pump falls to zero at *d* the delivery rate of the other pump increases to maximum at point *b*. In this way the aggregated delivery rate of the pumps is maintained and pulses in the delivery produced by the changing velocity of the pump pistons are eliminated or greatly reduced.

When the pump is in operation the rate of delivery is controlled solely by the speed of rotation of the shaft 12 and the angular position of the carrier 20. If the shaft 12 is rotated at a fixed constant speed, the operating frequency of the pumps is constant and changes in the delivery are obtained by varying the amplitudes of the strokes. This is achieved by moving the carrier 20 manually to different angular positions. The lever arms 16 and 17 have a magnification effect and the stroke length of each pump is dependent on the distance between the pivot point 18, 19 and the associated point of contact of the ram 10, 11 with the corresponding lever arms 16, 17. If the angle L (FIG. 1) is zero, the pivot points 18, 19 lie on the line of action of the rams 10, 11 which therefore remain stationary despite the fact that the cam followers 14, 15 continue to follow the profile of the cam 13.

To obtain maximum delivery from the pumps 10, 11 the angle L is increased until the cam followers 14, 15 lie on the line of action of the rams 10, 11.

In FIG. 1, the pivot points 18, 19 lie on a circle 100 shown in broken line. Irrespective of the angular position of the carrier 20 (i.e. the value of the angle L) the lever arms 16, 17 move backwards and forwards across the circle 100 as the cam 13 rotates. For a minimum pumping stroke i.e. when L approaches O, the rams 10, 11 reciprocate at the midway of the of the pumps 5, 6. This means that a dead column of fluid sits in the pumps, and separation of liquids or settlement of particles in this dead column may occur. To avoid this, it is essential that the pumps are almost completely evacuated during each delivery stroke, irrespective of the length of the stroke.

Figure 3:
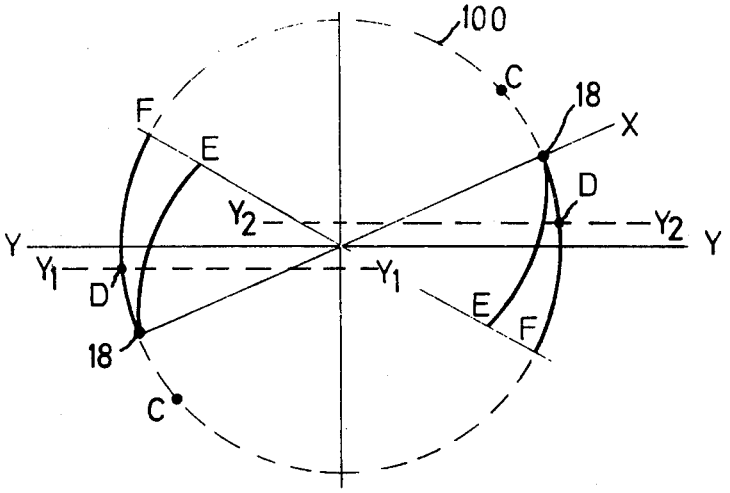
FIG. 3 shows diagrammatically how full pump evacuation irrespective of length of stroke may be achieved.

This is achieved, as shown diagrammatically in FIG. 3 by insuring that the pivot arms 16, 17 always lie on the circle 100 at the end of each delivery. The travel of each follower is indicated by the line EF. The actual size of the cam 13 (not shown in FIG. 3) determines the outermost position of the pivoting arms 16, 17. By suitable selection of the cam it is possible to ensure that the pivoting arms 16, 17 always lie on the circle 100 at maximum stroke. It is then a matter of selecting the length of the rams 10, 11 to ensure that this corresponds to full evacuation of the pumps 5, 6. Partly for geometrical reasons and partly to reduce side thrust on the rams, it is desirable to move the axes of the rams 10, 11 so that they lie on the lines $Y_1$—$Y_1$, and $Y_2$—$Y_2$ slightly below and above the line YY respectively. In this way the surfaces of contact between the rams and the pivoting arms deviate substantially equally on either side of the normal through the surfaces of contact throughout the stroke, i.e. as the arms move between E and F. The pivot points 18 are movable on rotation of the carrier (not shown in FIG. 3), between points C and D for maximum and minimum length of stroke, respectively.

Figure 4:
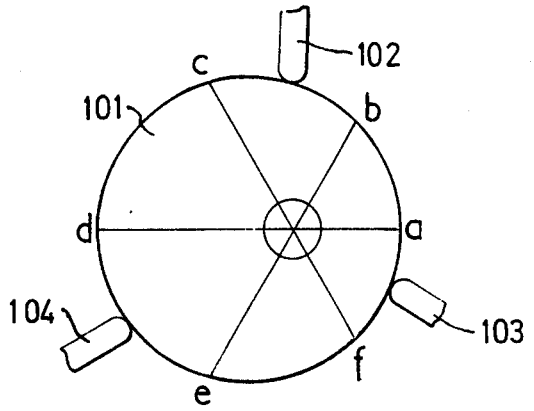
FIG. 4 shows a cam profile for producing constant delivery and suction rate.

FIG. 4 shows a cam 101 which provides constant suction and delivery rates irrespective of the length of the stroke. Three cam followers 102, 103, 104 are arranged at 120° around the cam 101. As can be seen from FIG. 4 the cam 101 is symmetrical about its maximum-minimum axis, *d* – *a* and divided into six equal sectors. Starting from point *a* there is a constant acceleration for 60° to point *b* followed by 60° of constant velocity topoint *c*, and then by 60° of constant decelertion to zero velocity at point *d*. Similarly, there is 60° of constant acceleration from *d* to *e*, 60° of constant velocity from *e* to *f* and 60° of constant deceleration from *f* to *a* zero velocity at *d*. At all times, irrespective of ram stroke length, the sum of the forward rams velocities is constant, and the sum of the back ram velocities is constant.

The arrangement shown in FIG. 4 can be adapted in a way similar to that shown in FIG. 3 to ensure full evacuation of the pumps irrespective of the length of the stroke.

Figure 5:
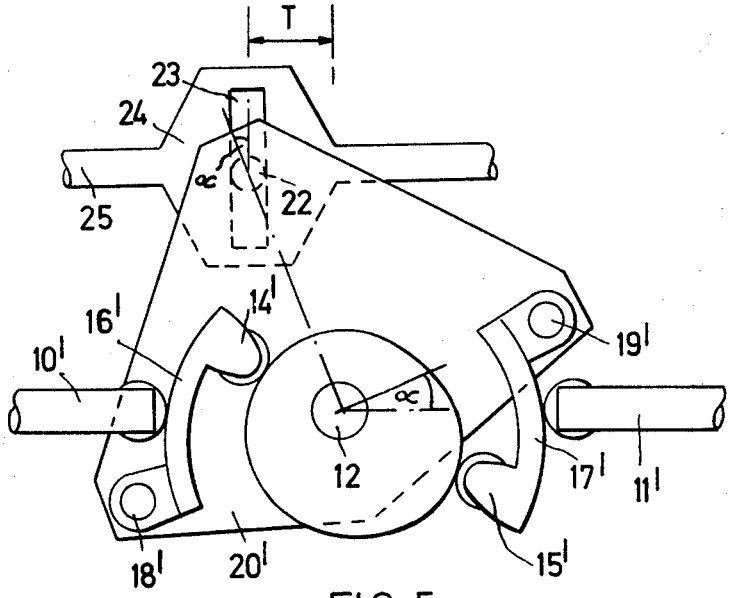
FIG. 5 shows a modification of a part of FIG. 1 to vary the delivery rate of the apparatus linearly in accordance with the movement of a driven element such as an actuator.

In the modification shown in FIG. 5, the parts corresponding to those in FIG. 1 are similarly referenced but the reference numerals are primed.

The carrier 20' is rockable about the axis of rotation of the shaft 12 through an angle $\alpha$. The rocking movement is controlled by a pin 22 attached to a plate 20' and slidable lengthwise of a slot 23 formed in an enlarged part 24 of a push-rod element 25 capable of displacing axially through a stroke T. The axis of the slot 23 is perpendicular to the line of action of the rams 10', 11' so that axial movement of the element 25 produces arcuate movement of the effective lengths of the lever arms 16', 19'. The length of the pump stroke varies as Sine $\alpha$, and Sine $\alpha$ is proportional to the stroke length T of the element 25. In consequence the stroke length of the pumps and therefore the delivery rate of the pumping apparatus varies linearly with the movement of the push-rod element 25.

Figure 6:
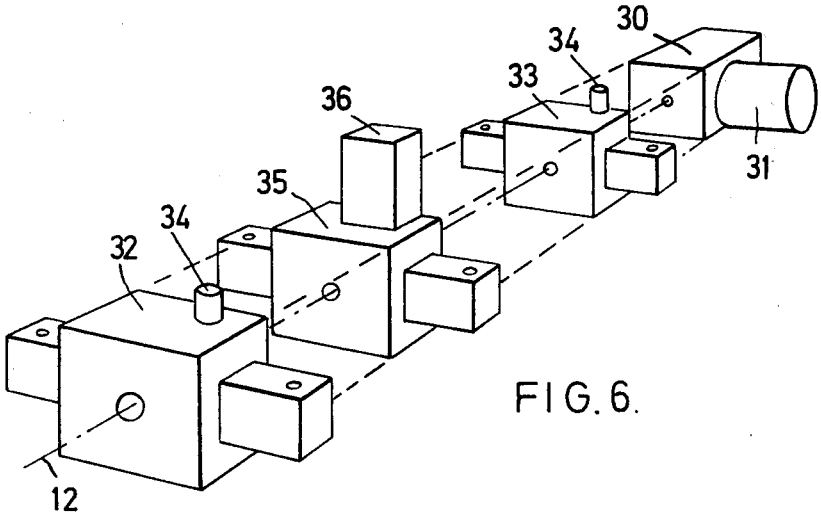
FIG. 6 shows a number of pumps ganged together to be driven by a common drive shaft.

FIG. 6 shows an assembly of pump units driven by a common drive shaft 12 from a reduction gear box 30 receiving drive from a motor 31. Units 32 and 33 each comprise a pair of duplex pumps having a controller 34 to enable the delivery rate of the pumps to be altered by angularly moving their respective carriers 20. The pump unit 35 also comprises a duplex pump with a powered stroke change 36 which may take the form of an actuator moving a push-rod 25 as shown in FIG. 4.

Various modifications may be made to the above-described pumping apparatus. Thus, the ram pumps may be replaced by diaphragm pumps.

An advantage of the pumping apparatus of the invention is that the fluid or liquid delivered is subtantially free of pumping pulses and therefore has a range of applications such as are numbered in the five examples beneath.

A. LOADING VALVE

Unless the point of delivery is lower than the top level of the chemical storage vessel no loading valve would be required. With loading valves the pumping head is a false one generated by this loading valve. The entire pump mechanism and drive system must therefore be scaled for the loading valve setting. Removal of this valve must therefore be an advantage.

B. MIXING

Continuous chemical injection is the ideal in the interest of perfect mixing. Continuous flow improves this and permits the pump stroke speed to run down to low speeds previously considered unwise because of "Slugging" of the dose.

C. DRIVE TORQUE

Steady drive torque is at all times desirable and especially so with certain variable speed devices.

D. FLOW CHECKING

Steady flow permits the use of simple flow indicating or detecting devices which cannot be used with conventional pumps.

E. PUMP FAILURE DETECTION

If a pump drive is running the only form of failure can be gland leakage or valve failure. The former is visible, the latter, difficult to detect in conventional pumps would show up immediately on the proposed design as a flow fluctuation. Steady flow must guarantee correct functioning.

It will be appreciated that the pumps used are conveniently in duplex, and may have a ram or diaphragm head. The heads of the two pumps must of course have identical outputs.

I claim:

1. Pumping apparatus suitable for pumping chemical fluids comprising a plurality of flowpaths extending between a fluid inlet and a fluid outlet, an identical reciprocating pump in each flow path, a housing between the pumps, a pump reciprocating member for each pump extending outwardly through said housing in sealing relation therewith, a respective cam follower device in said housing for each pump reciprocating member and in constant engagement therewith, continuously rotatable cam means in said housing constantly engaging said cam follower devices for actuating them and being shaped to provide a substantially constant pumped volume from said pumping apparatus, and pivotable carrier means in said housing, each cam follower device including an arm pivotably mounted at one end on said carrier means and a cam follower at the other end engaging said rotatable cam means, each arm having a convexly-curved surface engaging the pump reciprocating member of the respective pump, said carrier means being rotatable on the same axis as said rotatable cam means for altering the stroke of each pump when said carrier means is turned on said axis but still maintaining the pumped volume of said apparatus substantially constant, the pivotal mountings of the arms on the carrier means being arranged on a common circle, and the arms lying on the circle at maximum discharge of the pumps irrespective of the pivoting of the carrier means and being movable radially inwardly only of the circle.

2. Pumping apparatus suitable for pumping chemical fluids comprising a plurality of flowpaths extending between a fluid inlet and a fluid outlet, an identical reciprocating pump in each flow path, a housing between the pumps, a pump reciprocating member for each pump extending outwardly through said housing in sealing relation therewith, a respective cam follower device in said housing for each pump reciprocating member and in constant engagement therewith, continuously rotatable cam means in said housing constantly engaging said cam follower devices for actuating them and being shaped to provide a substantially constant pumped volume from said pumping apparatus, pivotable carrier means in said housing, said follower devices being pivotably mounted on said pivotable carrier means, and said carrier means being rotatable on the same axis as said rotatable cam means for altering the stroke of each pump when said carrier means is turned on said axis but still maintaining the pumped volume of said apparatus substantially constant, a linearly-movable adjustment member provided with a slot extending across its line of movement, and a pin projecting from said carrier means into said slot, whereby movement of the adjustment member causes movement of said pin lengthwise of the slot to turn the carrier means.

* * * * *